US009187945B2

(12) United States Patent
Back et al.

(10) Patent No.: US 9,187,945 B2
(45) Date of Patent: Nov. 17, 2015

(54) MULTI-COMPONENT DOOR JAMB AND STOP ASSEMBLY

(71) Applicant: Diversified Structural Composites, Inc., Erlanger, KY (US)

(72) Inventors: Mark A. Back, Myrtle Beach, SC (US); Geoffrey C. Card, Venice, FL (US)

(73) Assignee: Diversified Structural Composites, Inc., Erlanger, KY (US)

( * ) Notice: Subject to any disclaimer, the term of this patent is extended or adjusted under 35 U.S.C. 154(b) by 0 days.

(21) Appl. No.: 14/024,040

(22) Filed: Sep. 11, 2013

(65) Prior Publication Data

US 2014/0069038 A1 Mar. 13, 2014

Related U.S. Application Data

(60) Provisional application No. 61/699,657, filed on Sep. 11, 2012.

(51) Int. Cl.

| | |
|---|---|
| ***E06B 1/02*** | (2006.01) |
| ***E06B 1/04*** | (2006.01) |
| ***E06B 1/52*** | (2006.01) |
| ***E06B 1/32*** | (2006.01) |
| *E06B 1/18* | (2006.01) |

(52) U.S. Cl.

CPC . *E06B 1/52* (2013.01); *E06B 1/045* (2013.01); *E06B 1/32* (2013.01); *E06B 1/18* (2013.01)

(58) Field of Classification Search

CPC ..... E06B 1/003; E06B 1/02; E06B 1/04; E06B 1/12; E06B 1/18; E06B 1/32; E06B 1/52; E06B 1/56; E06B 5/00

USPC ..... 52/210, 204.1, 213, 215, 784.1, 656.2, 52/656.4, 745.15, 745.14

See application file for complete search history.

(56) References Cited

U.S. PATENT DOCUMENTS

| | | | | | |
|---|---|---|---|---|---|
| 3,274,735 | A * | 9/1966 | Stackhouse | 49/504 |
| 3,287,856 | A * | 11/1966 | Passovoy | 49/504 |
| 3,469,350 | A * | 9/1969 | Lange | 49/504 |
| 3,774,345 | A * | 11/1973 | Cole et al. | 49/504 |
| 3,774,360 | A * | 11/1973 | Hubbard et al. | 52/127.12 |
| 3,812,621 | A * | 5/1974 | Ragland | 49/505 |
| 4,034,514 | A * | 7/1977 | Cecil | 49/504 |
| 4,179,849 | A * | 12/1979 | Kuffner | 49/505 |
| 4,281,481 | A * | 8/1981 | Wendt | 49/504 |
| 4,376,354 | A * | 3/1983 | Passovoy | 49/504 |
| 4,656,691 | A * | 4/1987 | Allen | 16/251 |
| 5,070,651 | A * | 12/1991 | Jeter | 49/505 |
| 5,293,723 | A * | 3/1994 | Slessor | 52/213 |
| 5,497,594 | A * | 3/1996 | Giuseppe et al. | 52/843 |
| 5,787,660 | A * | 8/1998 | Adams | 52/212 |
| 5,836,118 | A * | 11/1998 | Thornton et al. | 52/204.1 |
| 6,412,227 | B1 * | 7/2002 | De Zen | 49/504 |
| 6,895,636 | B2 * | 5/2005 | Nussbaum | 16/241 |

* cited by examiner

*Primary Examiner* — Phi A

(74) *Attorney, Agent, or Firm* — Wood, Herron & Evans, LLP

(57) ABSTRACT

A multi-component door frame assembly, including a door jamb having a length and contact surface. A plurality of ribs along the length of the door jamb and extending distally from the contact surface. A door stop detachably fixed to the door jamb and adapted to receive a door when the door is in a closed position.

5 Claims, 6 Drawing Sheets

MULTI-COMPONENT DOOR JAMB AND STOP ASSEMBLY

TECHNICAL FIELD

This disclosure generally relates to doors, and more specifically, to door jambs and door stops.

BACKGROUND

Door assemblies are typically made up of a door frame cut out of a wall, a door jamb, a door stop, the door, and hinges and other fixtures (i.e. screws) to assemble the assembly. Door jambs and door stops are made of a variety of materials such as woods and metals. There are many disadvantages to the typical wood and metal constructions in the prior art. One-piece jamb and stop wood assemblies are costly to manufacture due to the time that must be spent machining the wood and due to the material wasted when machining wood. Both one piece and multi-piece jamb and stop assemblies are more difficult for the end user. With multiple piece wood assemblies, wood jambs must be fixed to the door frame, and then the stop must be fixed to the jamb and/or the door frame using many fasteners such as nails or staples. Furthermore, wood pieces are expensive and must be painted or stained. Metal door jambs and stops also provide similar disadvantages, especially with respect to cost. Therefore, there is a need for an inexpensive door jamb and stop assembly that can be installed easily and efficiently.

SUMMARY

It is an object of the invention to provide a multiple component door jamb and door stop assembly that is cost-effective and easy to manufacture, and which can be installed efficiently and cost effectively by the end user.

In one aspect of the present invention, a multi-component fiberglass door frame assembly comprises a door jamb having a length and a contact surface, and first and second channels along the length of the door jamb. Each channel has an opening at the contact surface, the opening extending proximally from the contact surface. First, second and third ribs along the length of the door jamb are provided. The first, second and third ribs each have widths and extend distally from the contact surface. The door frame assembly further comprises a door stop assembly detachably fixed to the door jamb and adapted to receive a door when the door is in a closed position.

In another aspect of the present invention, a method of assembling a door frame assembly comprises cutting a length of a fiberglass door jamb, machining a plurality of spaces into the door jamb for the placement of a plurality of hinges, cutting a length of a door stop assembly, fixing the door jamb to a door frame, fixing the plurality of hinges to the spaces in the door jamb, attaching the door stop assembly the door jamb; and attaching the door to the hinges.

In yet another aspect of the present invention, a method of assembling a door frame assembly comprises manufacturing a door jamb having a length and a contact surface. The door jamb further comprises first and second channels along the length of the door jamb. Each channel extends proximally from the contact surface. The door jamb further comprises first, second and third ribs along the length of the door jamb, the first, second and third ribs extending distally from the contact surface. The method further comprises machining the second and third ribs at multiple points along the length to create a plurality of spaces for the placement of a plurality of hinges. The spaces are disposed among the first, second and third ribs and each hinge has first, second, third and fourth edges. The method further includes fixing a hinge on the contact surface in each space. When each hinge is fixed into each space, each first edge substantially abuts the first rib, and each second and third edge substantially abut both the second and third ribs. The method further includes fixing a door stop assembly to the door jamb, the door stop assembly comprising a stop portion configured to accept a door when the door is in a closed position and first and second legs adapted to be detachably fixed within the first and second channels.

BRIEF DESCRIPTION

DETAILED DESCRIPTION

Figure 1:
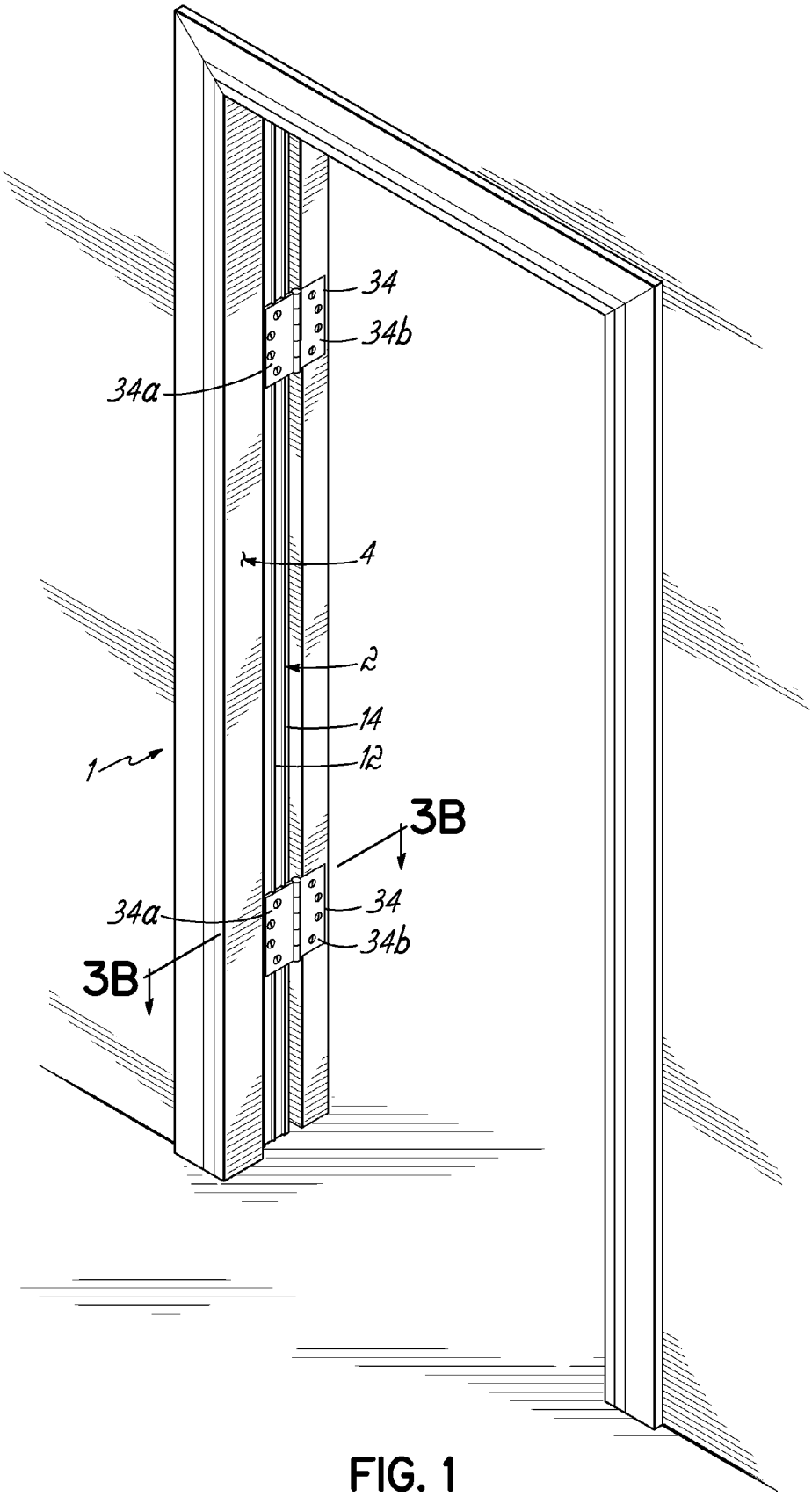
FIG. 1 is a perspective view of a door assembly with a door sash shown in an open position, including a door jamb and stop.

FIG. 1 is a perspective view of a door assembly portraying the assembly 1 including a door jamb 2 and door stop assembly 4 fixed to a door frame.

Figure 2A:
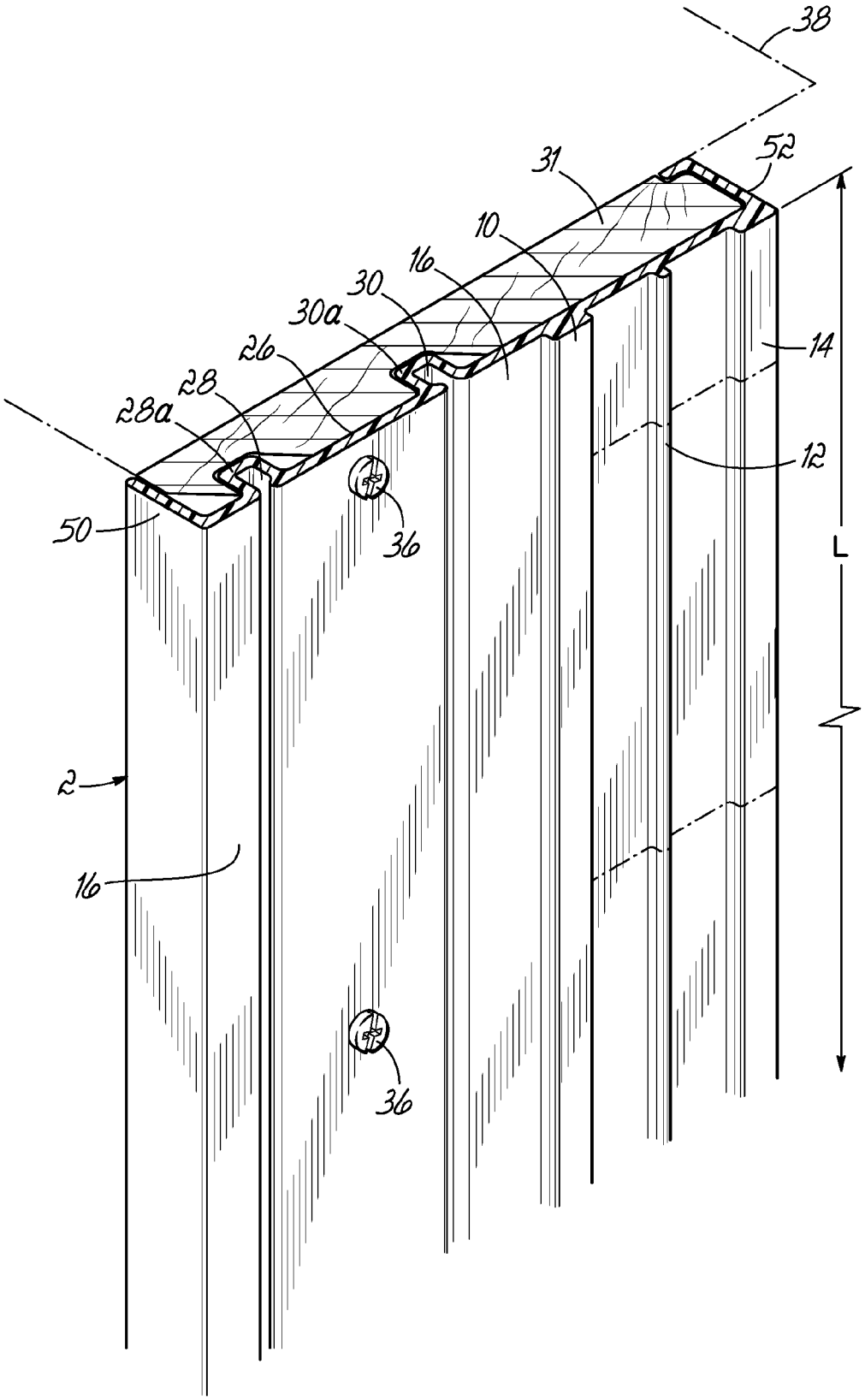
FIG. 2A is a perspective view showing the cross section of a door jamb fixed to a door frame.

As seen in FIG. 2A, jamb 2 includes a contact surface 16, a frame surface 26, first and second flanges 50, 52 extending proximally from the contact surface 16 and frame surface (not shown). Openings along the length L forms first and second channels 28, 30 extending proximally from the contact surface 16 along a length L of the jamb 2. Channels 28, 30 preferably are shaped to accept the first and second legs 6, 8 of stop assembly 4, respectively (see FIGS. 2B and 2C), to form an interference fit, but may be formed in a different manner to be fastened in an alternative way, such as using mechanical fasteners.

Jamb 2 has a frame surface (not shown) which is fixed to a door frame 31 by means of a plurality of screws 36, but other types of fasteners such as staples may be used. The door frame 31 may be configured to accept the protrusions 28*a* and 30*a* due to channels 28 and 30 and other portions of the jamb 2. The screws 36 may be applied along the length L of the jamb 2 and may be concealed when the legs 6, 8 of stop assembly 4 are fit into the channels 28 and 30, respectively (see FIGS. 2B and 2C), and the stop is engaged with the jamb 2. The flanges 50 and 52 may have a complementary shape with the door frame 31 that allows for easy installation and an aesthetically pleasing look after final installation. For example, in FIG. 2A, the flange 52 of jamb 4 has a "C-shape" to conceal one end of the door frame 31.

Figure 2B:
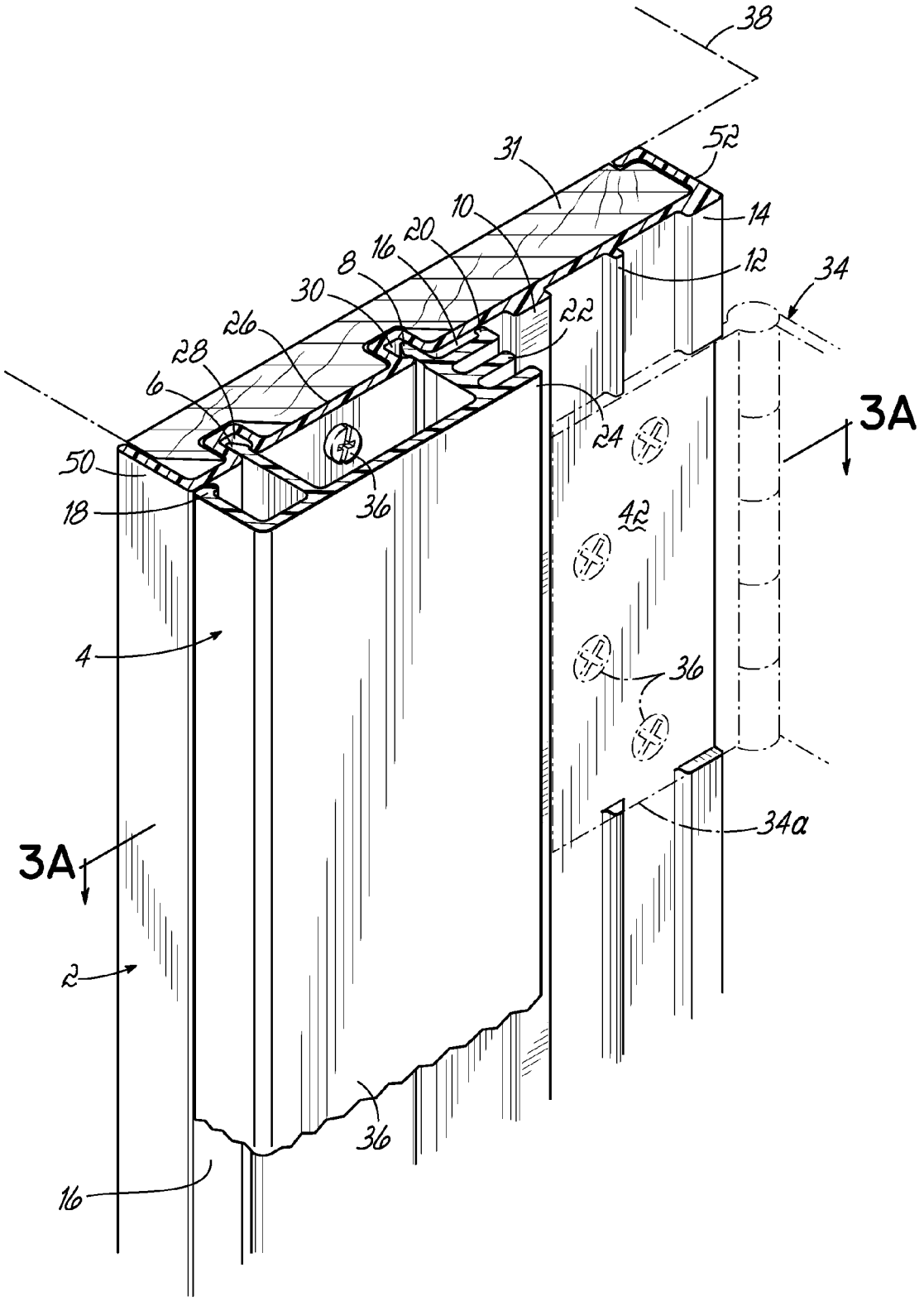
FIG. 2B is a perspective view showing the cross section of a door jamb fixed to a door frame and also including a door stop.
Figure 2C:
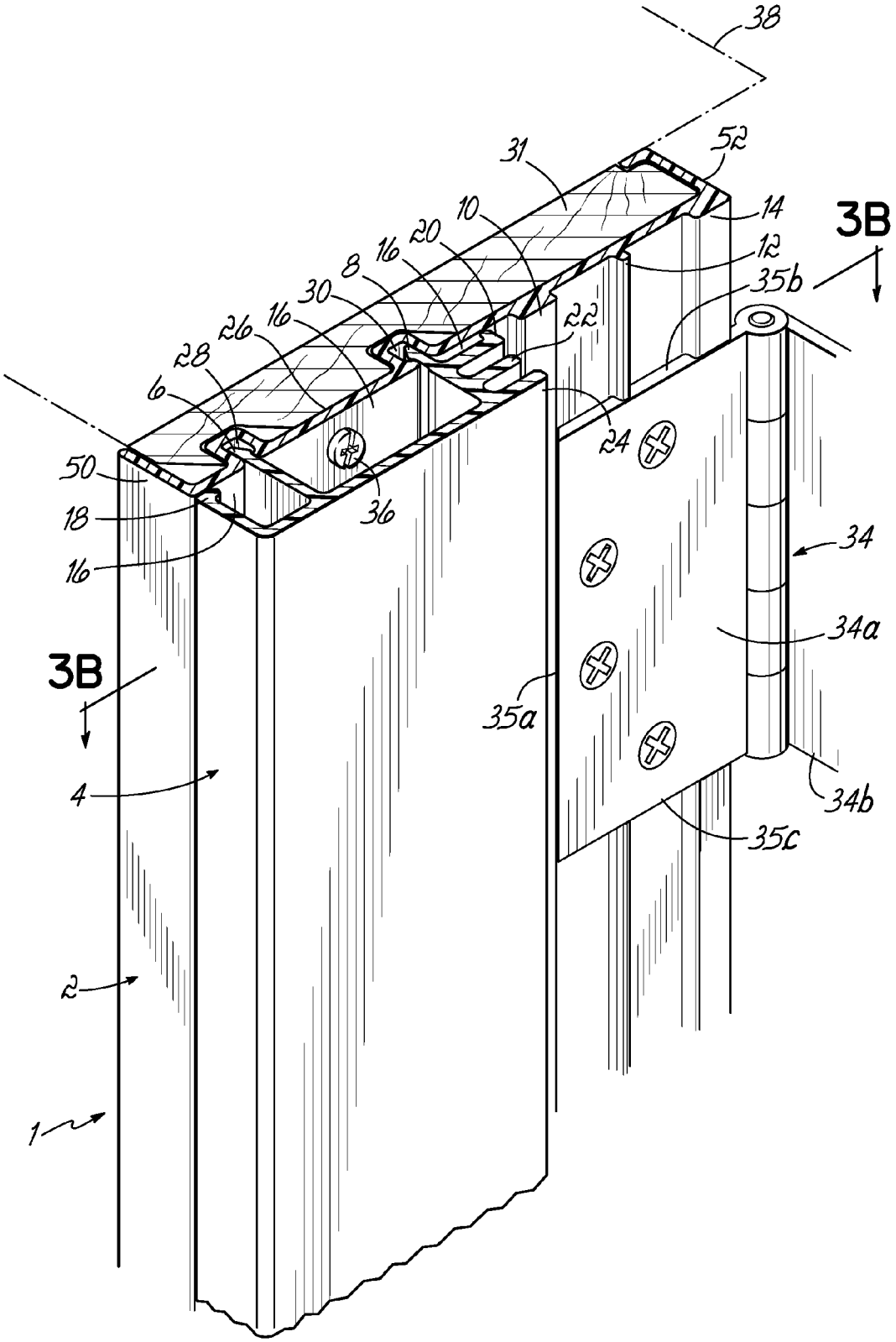
FIG. 2C is a perspective view showing the cross section of a door jamb fixed to a door frame and also including a door stop and a hinge.

Referring to FIGS. 2B and 2C, the first and second arms 18, 20 of the stop assembly 4 may engage the contact surface 16 of jamb 2 when the legs 6, 8 are engaged with the channels 28, 30. This engagement between the first and second arms 18, 20 and the contact surface 16 helps to prevent legs 6, 8 from progressing too far proximally in channels 28, 30. The stop 4 being fixed with respect to the jamb 4 at a point where the screws 36 will be concealed gives the entire assembly 1*a* more aesthetically pleasing look when assembled and installed on a door frame 31, due to the concealed nature of the screws 36.

The ribs 10, 12, and 14 may be of a suitable height in order for the hinge 34 to lay flush with the ribs 10, 12 and 14 in the machined space 42. The jamb 2 is manufactured having the ribs 10, 12 and 14 along the entire length. When received by the customer, who may be an installer of doors, windows and similar fixtures, the customer may cut the pieces of jamb 2 and stop 4 in order to comply with the end user's specifications. In order to accommodate for door hinges 34, the customer may also machine spaces 42 (shown in phantom) out of the second and third ribs 12, 14 according to the size of standard door hinges in the industry, or alternatively, hinges which are custom to a particular customer or client.

Figure 3A:
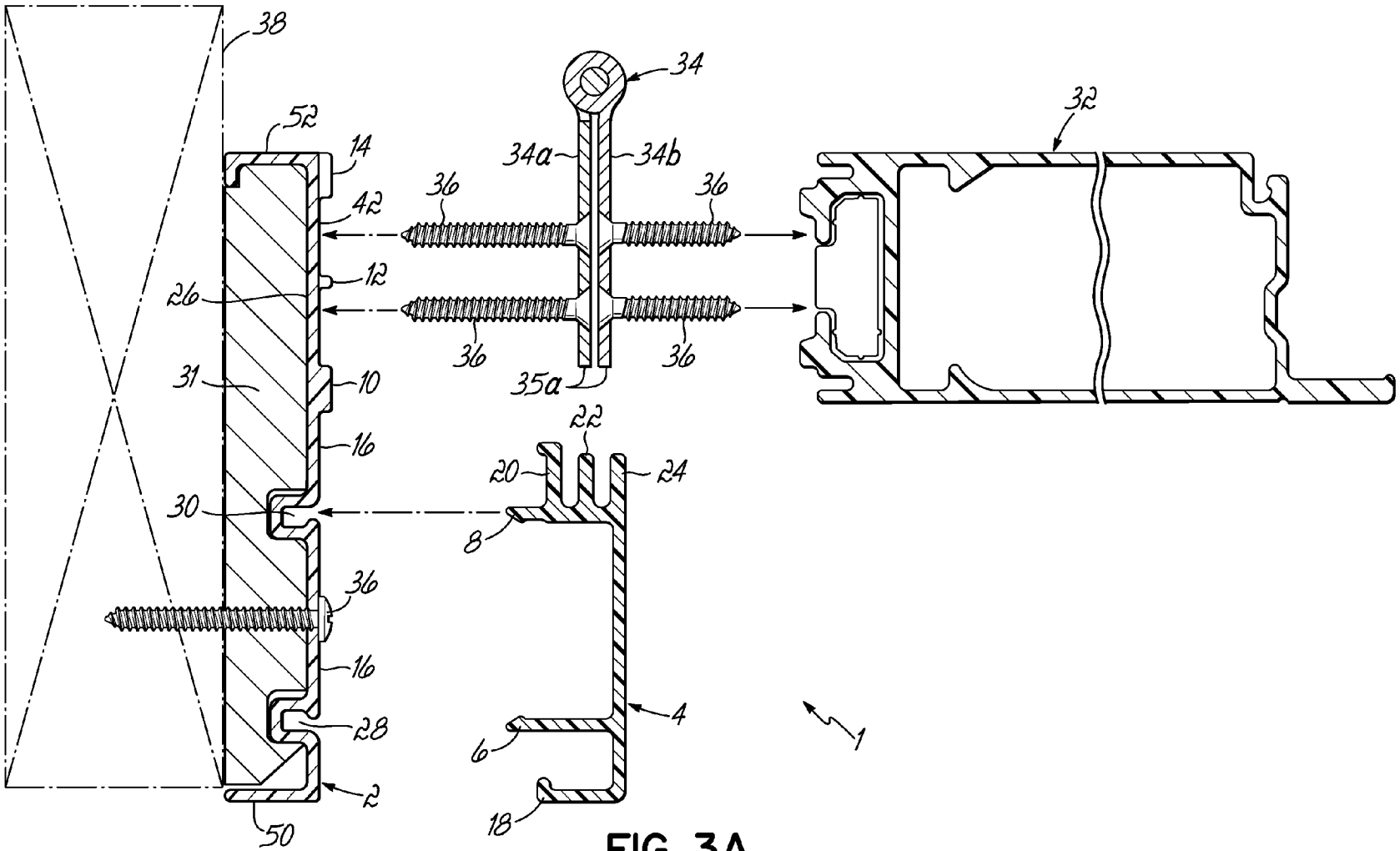
FIG. 3A is a top view of a cross-sectional view showing an exploded door assembly
Figure 3B:
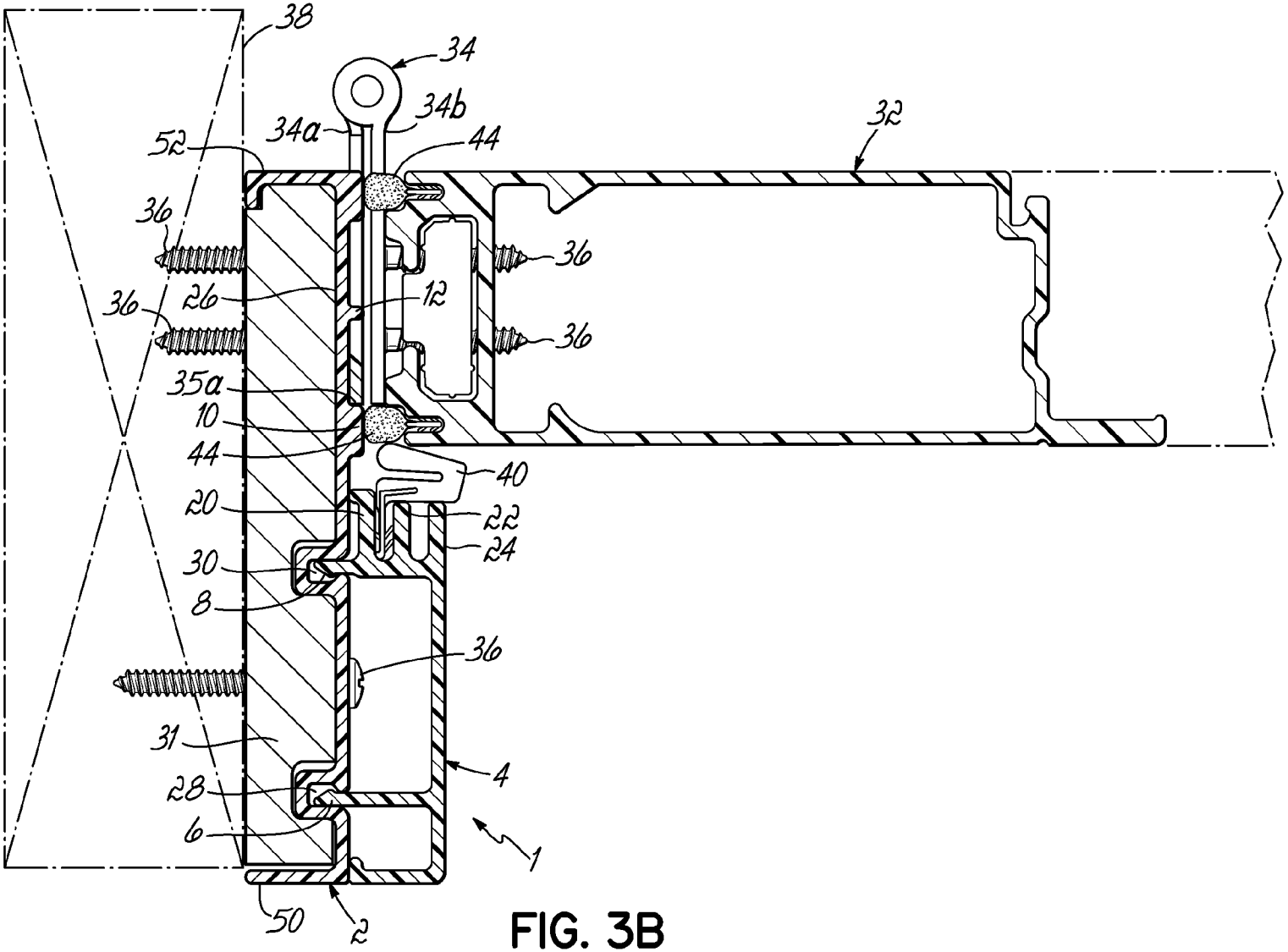
FIG. 3B is a top cross-sectional view showing a door assembly.

The hinge 34 is fixed to the door frame 31 by fasteners such as screws 36, which are screwed through holes in the hinge 34 and through the jamb 2 and into the door frame 31 and wall 38 (see FIGS. 3A and 3B). Each hinge 34 has first, second and third edges 35*a*, 35*b*, 35*c*. On each hinge 34, each first edge 35*a* substantially abuts the first rib 10, and each second and third edge 35*b*, 35*c* substantially abut both the second and third ribs 12, 14. The portions of the first, second and third ribs 10,12 and 14 which are essentially in contact with the edges 35*a*, 35*b*, 35*c* of hinge 34 provide additional support for the hinge 34 and door sash 32 when the hinge is experiencing forces from the weight of the door and outside forces, in both static and dynamic conditions.

In a preferred embodiment, the first and third ribs 10, 14 have a larger width than the second rib 12. This particular arrangement provides manufacturing benefits such as ease of manufacturing and cost savings due to less material being used from the smaller width of material such as fiberglass. However, different configurations also realizing similar or different manufacturing and other benefits may be utilized.

As seen in FIG. 3B, the stop 4 also accepts a door when it is part of a door sash 32, door frame and door jamb assembly 2. There may be a weather stripping 40 disposed between the second and third arms 20, 22 of the stop 4 to aid the stop in stopping the door sash 32. Alternatively, the weather stripping 40 may be disposed at a different part of the stop 4 or may be included as a part of the stop 4. The weather stripping 40 is a well known part in the industry.

The door jamb 2 and stop assembly 4 may be manufactured into elongated portions, either by extrusion or pull-trusion, or any other suitable method of manufacture. After manufacture, the individually manufactured pieces of jamb 2 and stop 4 will be shipped in preferably fourteen-foot-long pieces, but may be shipped in any length suitable to the manufacturer or customer. When received by the customer, who may be an installer of doors, windows and similar fixtures, the customer may cut the pieces of jamb 2 and stop 4 in order to comply with the end user's specifications. In order to accommodate for door hinges, the customer may also machine spaces 42 out of the second and third ribs 12, 14 according to the size of standard door hinges in the industry, or alternatively, hinges which are custom to a particular customer or client. A jamb 2 with a machined space 42 for a hinge 34 is shown in FIGS. 2A and 2B (in phantom).

In a preferred embodiment, the entire assembly 1 includes two components, the jamb 2 and the stop 4. In other embodiments, however, the assembly may include more than two components. For example, the jamb 2 or the stop 4 may comprise multiple sub-components to be assembled together.

FIGS. 3A and 3B show the assembly 1 as part of a full door assembly. The jamb 2 is fixed to the door frame 31 by a plurality of screws 36 extending through the door frame 30 and into the wall or other structure 38. Preferably, particular portions of second and third ribs 12, 14 have been machined down so stationary portion 34*a* of hinge 34 can lay flush in a machined space 42 among portions of the first, second and third ribs 10, 12 and 14. The stationary portion 34*a* of the hinge 34 is fastened to the jamb 2, door frame 31 and wall 38 by means of a screw 36 or other fastener. The legs 6, 8 of stop assembly 4 are fit into the channels 28 and 30 of the jamb 2, respectively. Preferably, there is an interference fit between the respective legs 6, 8 and channels 28, 30 to ensure a secure fit of the stop assembly 4 with the jamb 2. The placement of legs 6, 8 within channels 28, 30 will also cause arms 18 and 20 to engage the contact surface 16 of the jamb 2. This placement of the stop assembly 4 preferably conceals the screws 36.

Door sash 32 will be fixably connected to rotatable component 34*b* of hinge 34, making it rotatably fixed with respect to stationary component 34*a* of hinge 34, door jamb 2, and door stop assembly 4. When the door is in the closed position as shown in FIG. 3B, at least a portion of door sash 32 will rest against or be accepted by either the stop 4 or an optional weather stripping 40. The weather stripping 40 may be disposed between the second and third arms 20, 22 of the stop. Alternatively, the weather stripping may be disposed at a different part of the stop or may be included as a part of the stop. The weather stripping 40 may be integrated into door stop assembly 4 to form a unitary item or may be a separately manufactured component as part of a multi-part assembly.

A method of assembling a door frame assembly is provided, including manufacturing a door jamb 2 having a length L and a contact surface 16. The door jamb further has first and second slots 28, 30 along the length L. Each channel 28, 30 has an opening at the contact surface 16 and extends distally from the contact surface 16. The jamb 2 also includes first, second and third ribs 10, 12, and 14 which extend proximally from the contact surface 16 of the jamb 2. The method also comprises machining the second and third ribs 12, 14 at multiple points along the length L to create a plurality of spaces 42 (shown in phantom) for the placement of a plurality of hinges 34. The machined spaces 42 are disposed among the first, second, and third ribs 10, 12 and 14 as seen in FIGS. 2A-2B. The method further comprises fixing a hinge 34 into each space 42. Each hinge 34 has first, second and third edges 35*a*, 35*b*, 35*c*. On each hinge 34, each first edge 35*a* substantially abuts the first rib 10, and each second and third edge 35*b*, 35*c* substantially abut both the second and third ribs 12, 14 while engaged within the machined space 42. The method further comprises fixing a door stop assembly 4 to the jamb 2. The door stop assembly 4 comprises a weather stripping 40 which may accept a door sash 32 when the door is in a closed position. The door stop assembly 4 has first and second legs 6, 8 adapted to be detachably fixed within the first and second channels 28, 30 due to, for example, an interference fit.

From the above disclosure of the general principles of the present invention and the preceding detailed description of at least one preferred embodiment, those skilled in the art will readily comprehend the various modifications to which this invention is susceptible. Therefore, we desire to be limited only by the scope of the following claims and equivalents thereof.

What is claimed is:

1. A multi-component door frame assembly comprising:

a door jamb having a length and an interior surface adapted to receive a door frame and an exterior surface including a substantially planar contact surface adapted to receive a hinge;

a plurality of ribs along the length of the door jamb and attached on and extending distally away from the contact surface and away from the interior surface;

a door stop detachably fixed to the door jamb and adapted to receive a door when the door is in a closed position;

a plurality of channels along the length of the door jamb, each channel extending proximally from the contact surface;

a plurality of legs extending proximally from a top portion of the door stop and configured to engage with the plurality of channels;

a first arm extending proximally from the top portion of the door stop; and a plurality of arms extending laterally from the plurality of legs, where at least one of the plurality of arms has a proximally extending flange, wherein when the legs are engaged with the channels, the first arm and the flange engage the contact surface of the door jamb.

2. A multi-component door frame assembly comprising:

a door jamb having a length and an interior surface adapted to receive a door frame and an exterior surface including a substantially planar contact surface adapted to receive a hinge;

a plurality of ribs along the length of the door jamb and attached on and extending distally away from the contact surface and away from the interior surface;

a door stop detachably fixed to the door jamb and adapted to receive a door when the door is in a closed position;

a plurality of channels along the length of the door jamb, each channel extending proximally from the contact surface;

a plurality of legs extending proximally from a top portion of the door stop and configured to engage with the plurality of channels, wherein the plurality of legs and plurality of channels form an interference fit therebetween, respectively, upon engaging;

a first arm extending proximally from the top portion of the door stop; and a plurality of arms extending laterally from the plurality of legs, where at least one of the plurality of arms has a proximally extending flange, wherein when the legs are engaged with the channels, the first arm and the flange engage the contact surface of the door jamb.

3. The multi-component door frame assembly of claim 2, wherein at least one of the plurality of ribs has a smaller width than that of the other ribs.

4. The multi-component door frame assembly of claim 3, wherein the plurality of ribs includes first, second, and third ribs, the second rib having a smaller width than that of the first and third ribs.

5. A multi-component door frame assembly comprising:

a door jamb having a length and an interior surface adapted to receive a door frame and an exterior surface including a substantially planar contact surface adapted to receive a hinge;

a hinge attached to the contact surface;

a plurality of ribs along the length of the door jamb and attached on and extending distally away from the contact surface and toward the hinge; and a door stop detachably fixed to the door jamb and adapted to receive a door when the door is in a closed position;

a plurality of channels along the length of the door jamb, each channel extending proximally from the contact surface;

a plurality of legs extending proximally from a top portion of the door stop and configured to engage with the plurality of channels;

a first arm extending proximally from the top portion of the door stop; and a plurality of arms extending laterally from the plurality of legs, where at least one of the plurality of arms has a proximally extending flange, wherein when the legs are engaged with the channels, the first arm and the flange engage the contact surface of the door jamb.

* * * * *